US008540086B2

(12) United States Patent
Karst

(10) Patent No.: US 8,540,086 B2
(45) Date of Patent: Sep. 24, 2013

(54) WEAPON WALL MOUNT AND LOCKING METHOD AND APPARATUS

(76) Inventor: Jeremy Karst, Bellingham, WA (US)

( * ) Notice: Subject to any disclaimer, the term of this patent is extended or adjusted under 35 U.S.C. 154(b) by 137 days.

(21) Appl. No.: 13/015,990

(22) Filed: Jan. 28, 2011

(65) Prior Publication Data

US 2011/0198474 A1 Aug. 18, 2011

Related U.S. Application Data

(60) Provisional application No. 61/304,422, filed on Feb. 13, 2010.

(51) Int. Cl.
*A47F 7/00* (2006.01)
*E05B 73/00* (2006.01)

(52) U.S. Cl.
USPC ..... 211/64; 211/4

(58) Field of Classification Search
USPC ..... 211/64, 60.1, 4, 87.01, 86.01, 13.1; 70/58, 62; 42/70.01, 70.06, 106; 248/110, 248/111, 203, 551–553; 29/428
See application file for complete search history.

(56) References Cited

U.S. PATENT DOCUMENTS 3,468,427 A * 9/1969 Leslie ..... 211/64
3,620,493 A * 11/1971 Huver ..... 248/692
4,050,662 A * 9/1977 Pickering ..... 248/309.2
4,182,453 A * 1/1980 Worswick ..... 211/4
4,198,026 A * 4/1980 Capolupo ..... 248/552
4,624,372 A * 11/1986 Brolin ..... 211/4
4,792,050 A * 12/1988 Allen ..... 211/64
4,936,038 A * 6/1990 Johnson et al. ..... 42/106
5,188,328 A * 2/1993 Thompson ..... 248/309.2
5,271,174 A * 12/1993 Bentley ..... 42/70.11
5,287,972 A * 2/1994 Saathoff ..... 211/64
5,339,966 A * 8/1994 Bastiaans ..... 211/4
5,579,923 A * 12/1996 Hemmerlein ..... 211/4
5,621,996 A * 4/1997 Mowl, Jr. ..... 42/70.07
5,926,989 A * 7/1999 Oliver, Sr. ..... 42/70.11
6,021,936 A * 2/2000 Savant ..... 224/401
6,575,343 B2 * 6/2003 Mossman ..... 224/198
7,216,449 B2 * 5/2007 Riebling et al. ..... 42/70.07
7,716,865 B2 * 5/2010 Daniel et al. ..... 42/75.02
7,836,625 B2 * 11/2010 Swan et al. ..... 42/127
2003/0075574 A1 * 4/2003 Mossman ..... 224/198
2003/0102273 A1 * 6/2003 McMurray ..... 211/5
2004/0129038 A1 * 7/2004 Vercoe ..... 70/58
2006/0117634 A1 * 6/2006 Vor Keller et al. ..... 42/70.11
2008/0092422 A1 * 4/2008 Daniel et al. ..... 42/90
2011/0131859 A1 * 6/2011 Lawson ..... 42/90
2011/0198474 A1 * 8/2011 Karst ..... 248/551

* cited by examiner

*Primary Examiner* — Jennifer E. Novosad

(57) ABSTRACT

A weapon wall mount is provided with the mount having a continuous base plate which matches the silhouette of a weapon. The continuous base plate has equidistantly spaced countersunk holes providing uniform attachment to a wall. The wall having wall studs spaced at least between a range of 12 inches to 24 inches on center. The base plate has a transversely aligned support which provides longitudinal and vertical support to the weapon. In addition the base plate has a transversely aligned locking shaft to receive a lock. When mounted, the weapon restricts access to the equidistantly spaced countersunk holes so that the mount and weapon cannot be easily removed from the wall. This mount also provides the appearance of the weapon securely fastened and mounted to the wall without the noticeable visual appearance of any support.

20 Claims, 7 Drawing Sheets

WEAPON WALL MOUNT AND LOCKING METHOD AND APPARATUS

This application claims priority benefit of U.S. Ser. No. 61/304,422, filed Feb. 13, 2010.

BACKGROUND

U.S. Pat. No. 3,637,180 discloses a wall mount device for guns where the device is for mounting and locking a gun into place on a wall. The device consists of essentially two parts, a cylindrical member having a base and means associated with the base for affixing the cylindrical member to the wall, plus a latch member adapted to be received within the cylindrical member. The device projects through the trigger guard of the gun such that the gun rests upon the cylindrical member itself. A head at the outer end of the latch member, larger than the trigger guard, prevents removal of the gun.

U.S. Pat. No. 7,216,449 discloses a safety device for firearms which has a trigger and trigger guard. The firearm safety device includes a first and second assembly adapted to be secured to the firearm on opposite sides of the trigger guard to prevent access to an actuation of the trigger. The firearm safety device includes a lip disposed on at least one of the first and second assemblies for overlapping the other assembly when the safety device is secured to the firearm.

U.S. Pat. No. 4,182,453 discloses a rack for displaying and securing guns which has a bar secured to a wall and a number of gun supports attached to the bar. When guns are placed on a support, the fastening, securing the bar to the wall and the fastenings attaching the gun supports to the bar are hidden. A locking pin passes through the trigger guard of each gun and is locked in a recess in the base. Common locking mechanisms can lock all the pins on one rack.

Referring to column 1 around line 64 "a steel plate is securely bolted to the wall using raw bolts or similar methods. A cover which has a recess on its rear face so that it will fit over the plate is secured to the plate by means of a number of counter sunk head set screws passed through the cover and into the plate. The base is then fixed to the wall and the main fixing screws are concealed by the cover. Each gun support platform is attached to the cover by means of the set screws. This is the only attachment to each platform and therefore by slightly slackening the screw the platform can be pivoted to alter the alignment of the barrels of the gun resting on the support. When the gun is in place, the set screws are concealed by the central part of the gun so that it can not be unscrewed. A locking pin has a head where the shank of the pin passes through the trigger guard of the gun but the head is so large that it would not pass through the guard and the guard will not be able to pass back over it."

Furthermore in column 2 around line 49 "clearly, the rack can accommodate any number of guns as desired. The platform has a part which extends on the other side of the base. This part prevents a screwdriver from being used to unscrew the screws securing the trigger guard. If this was not done, it would be possible to remove these two screws and then to wrench the gun from its place."

U.S. Pat. No. 5,339,966 discloses a device for locking and mounting a firearm with a base and two upstanding sidewalls, each sidewall defining a groove adjacent to the floor. The device also has a first member pivotably mounted between the two sidewalls, a second member slidably in the grooves and adapted to couple with the first member to lock the firearm between two protruded parts of the firearm, a lock pin for locking the second member and a lock for locking the lock pin. The floor has a least one through hole each for the passage of the fastener.

As can be seen in column 2 around line 13 "the firearm is supported and locked by a locking device and supported by a barrel or fore end supporting device. The locking device has a base, a pivotable member, a slideable member, a lock pin, (a deadbolt), and a lock operable by a key. The locking device locks the firearm between the butt stock and the trigger housing of the firearm. The slideable member and the pivotable member couple with each other to deny passage of the butt stock and the trigger housing of the firearm and deny any movement of the firearm away from the locking device."

U.S. Pat. No. 6,303,815 discloses an apparatus and method for securely mounting a firearm to a support structure such as a motor vehicle and includes a base plate defining a generally plainer mounting surface, a locking pin, a guide pin, and a plurality of mounting posts extending away from the mounting surface in orthogonal relation thereto.

U.S. Pat. No. 5,287,972 discloses a gun rack for storing and displaying a plurality of firearms. The gun rack includes a substantially rectilinear frame having a number of laterally spaced uprights and a number of vertically spaced crossbars spanning between the up rights. The frame is attached to a vertical mounting surface such as wall. A relatively flat panel member is adapted to attach to the frame, to substantially cover the frame and prevent the frame from being detached from the mounting surface.

U.S. Pat. No. 5,271,174 discloses a combination wall mount/portable gun lock assembly which has a U-shaped locking bar and a pair of laterally spaced leg members. One leg member is inserted into the open end of the gun barrel until it is in the firing chamber. The other leg member has a transversely extending leg portion formed on its end that passes through the trigger guard aperture when the locking bar is installed on the gun.

A combination lock is then inserted over the free end of the transversely extending leg portion and pressed tightly against the trigger guard. The locking bar prevents the chambering of a round in the firing chamber of the gun. The U-shaped locking bar can be passed through transversely aligned apertures in the wall mount unit when it is desired to mount the gun on a wall.

U.S. Pat. No. 5,621,996 discloses a combination security and display device for firearms which uses a pair of complementary casings that can be locked into a closed position whereby the casing substantially surrounds to prevent access to the operational portions of the firearm.

US patent application 2003/0102273 discloses a mounting apparatus which includes a base having a first and second end with a first support member positioned on the first end of the base and a second support member positioned on the second base. A locking bar is pivotably secured at one end to the second support member and has an opposite end lock. The post engages a switch of the device, for example a firearm, to prevent activation of the firearm.

DESCRIPTION OF THE PREFERRED EMBODIMENTS

Figure 1:
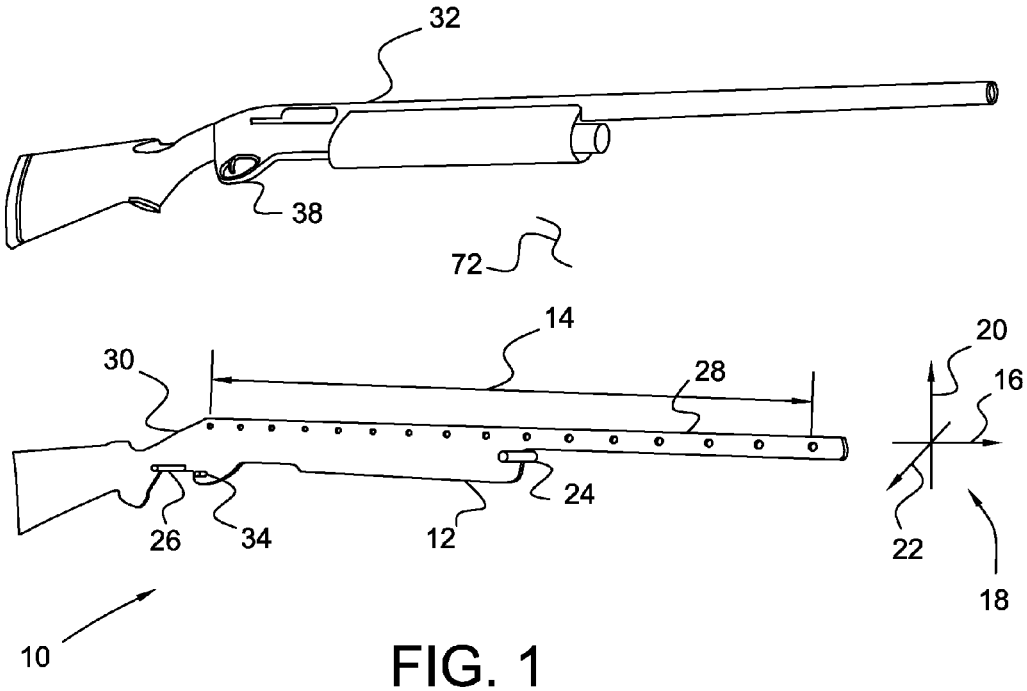
FIG. 1 is an elevation perspective view of the weapon wall mount and firearm.

The general concept is to provide a way for weapon owners such as firearm owners to display their firearms or compound bows and the like on the wall and provide a deterrent for removing the weapons from the wall display location. Accordingly, a weapon wall mount and locking apparatus 10 as seen in FIG. 1 is constructed of a base plate 12 where the base plate is cut to match the silhouette of the weapon in this case a firearm 32. The base plate itself may be constructed of iron, steel, fiberglass, composites, carbon fiber, or other material which would provide for rigid support of the weapon. The present embodiment utilizes a steel base plate and is encased with an outer covering layer to prevent scratching of the weapon. The outer covering can be any of a number of materials such as a powder coating, rubber coating, silicone coating, or other non abrasive material.

In this particular embodiment, the firearm 32 is a shotgun or rifle, and the base plate 12 has a barrel portion 28 and a stock portion 30. While the present embodiment of the weapon mount 10 is constructed in the silhouette of a rifle or shotgun, the fire mount 10 can be constructed to match any other type of weapon currently available or in the future. By way of example, the wall mount 10 profile may be for a handgun, a tommy gun, a machine gun, a rifle, a compound bow, or any other weapon, with some common elements being that the weapons may have a trigger guard, or a handle/stock portion, or a barrel upon which the weapon rests on the seating support and utilize the locking mechanism of the weapon wall mount 10.

In order to attach the wall mount 10 to the wall, a plurality of counter sunk holes 14 are provided at a 2" on-center longitudinal spacing for wall stud mounting 19 to the wall. These counter sunk holes are arranged along the longitudinal axis 16 of the base plate 12. The wall mount 10 is arranged about an axis system 18 which includes the previously mentioned longitudinal axis 16, a transverse axis 22, and a vertical axis 20. The weapon wall mount 10 is covered with a scratch resistant material to prevent damage of the firearm 32 when placed on the wall mount 10. In this particular embodiment, the scratch resistant material is a rubber coating which is laid on the outer surface of the wall mount 10, and in other embodiments a powder coating is utilized.

In order to hold the mounted position of the weapon, the wall mount 10 has a forward support 24 and a rear support 26. The supports are provided as, in this particular embodiment, transversely aligned approximately ¼" diameter (min) bars which are welded or fixedly attached by similar means to the outer edge of the base plate silhouette. When the firearm 32 is mounted onto the base plate, the effect is of the firearm 32 essentially freely mounted to the wall with nearly no attachments showing of the underlying base plate. The base plate 12 is for the most part hidden behind the weapon, because the base plate profile has lesser outer dimensions than the weapon itself. Furthermore, because the base plate may be covered in a black powder coating, the coating creates the effect of a back shadow of the weapon placing more emphasis on the firearm than on the wall mount itself 10. In order to prevent the firearm 32 from being removed from the wall mount 10, a locking mechanism is provided in this embodiment through a trigger 38 to effectively lock the firearm onto the wall mounts 10.

The mount 10 acts as a visual aid when choosing a location to mount the weapon on the wall. In other words, instead of using the valuable weapon itself as a guide for proper location on the wall, the weapon wall mount 10 having the same overall profile of the firearm 32 can be used to center and level the mounting of the weapon by acting as a template and enabling the user to get a general feel for how the weapon will be presented. Subsequently, when the weapon is placed on the wall mount 10, it is automatically positioned in its proper location and no further adjustments are necessary.

Figure 2:
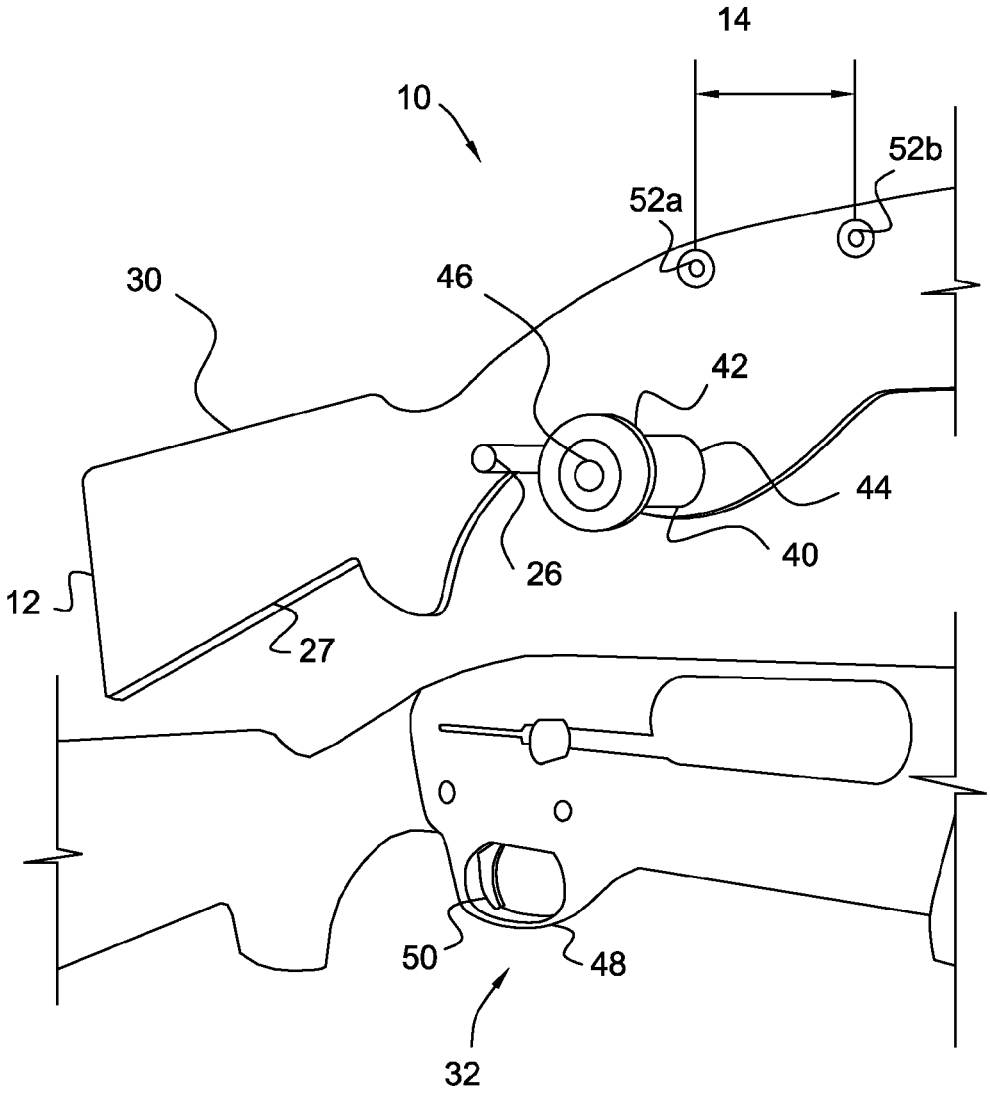
FIG. 2 is a detailed perspective view of the weapon wall mount and firearm.

Referring to FIG. 2, the firearm 32 is shown in partial alignment with the weapon mount and locking apparatus 10. A more detailed discussion of the weapon mount as it interacts with the rear support 26 and the trigger guard 48 of the firearm 32 will now be provided. As previously discussed, the transversely aligned rear support 26 is welded to the outside edge 27 of the base plate 12. The rear support as well as the forward support may be placed anywhere along the outside edge 27 where they can provide adequate vertical support for the firearm 32. While two supports are provided, it is easily conceived that more than two supports can be provided as required for any particular firearm design. It is also conceivable that a single support attached along the edge at a particular location to support the entire firearm may be provided.

Figure 3:
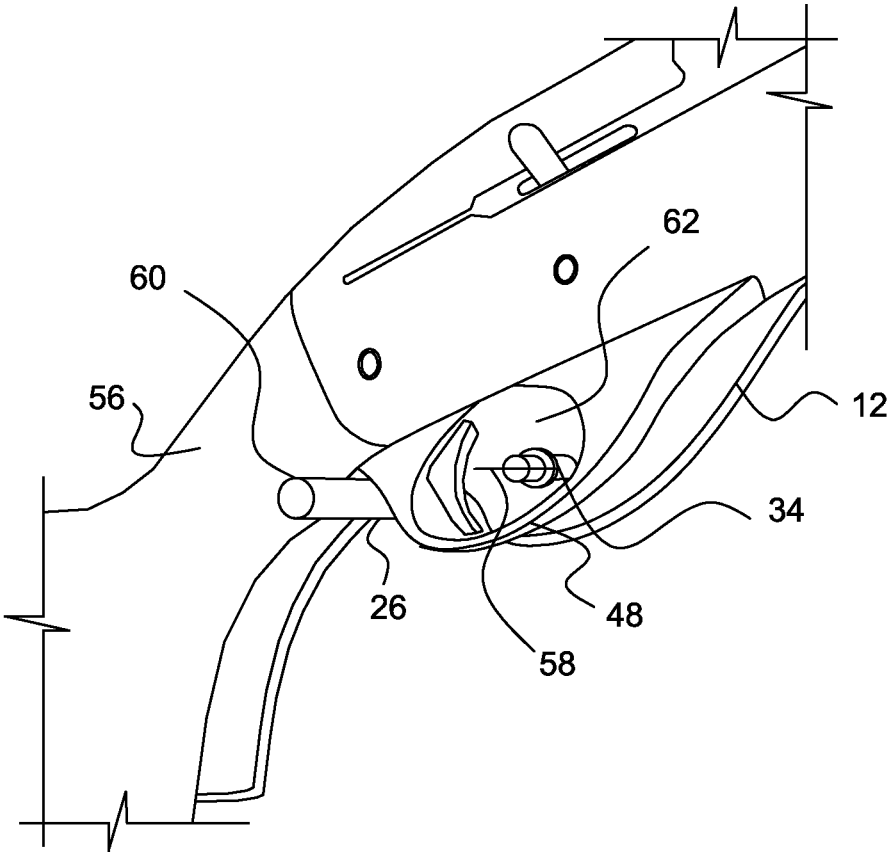
FIG. 3 is a detailed perspective view of the fire arm mounted on the wall mount without the locking mechanism.
Figure 4:
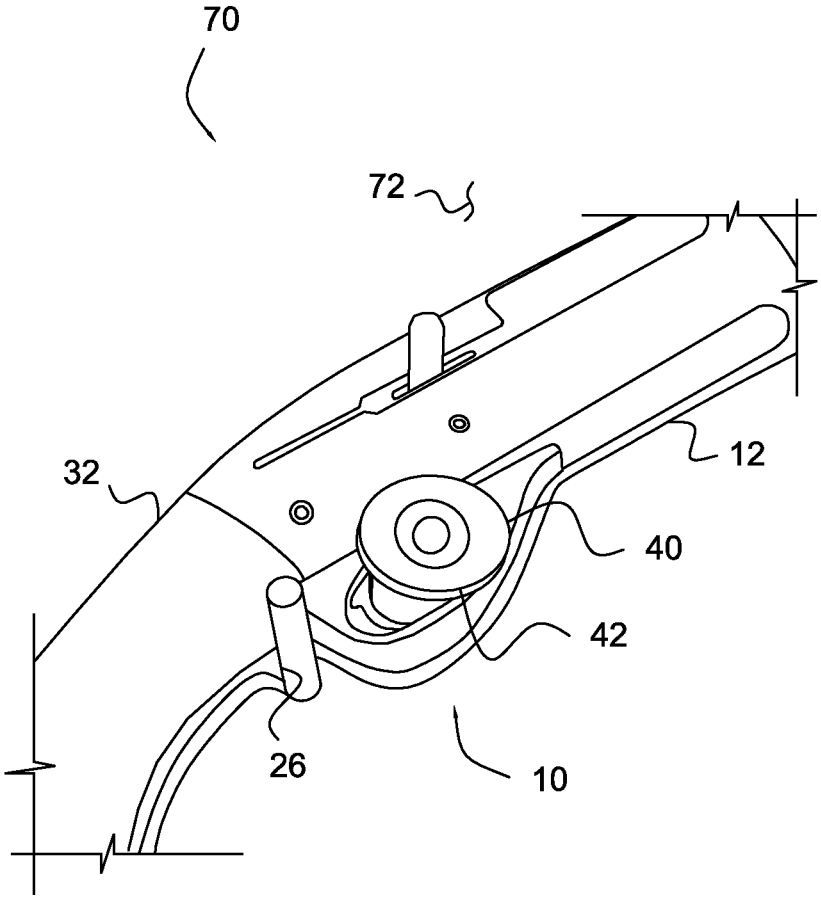
FIG. 4 is a detailed perspective view of the fire arm mounted on the wall mount secured by the locking mechanism.

The weapon mount 10 as seen in FIG. 2 is presently shown with the locking mechanism 40 attached to the locking shaft 34. In order to secure the firearm to the weapon mount 10, the user will have to engage the locking keyhole 46 and remove the cylindrical housing 44 which also carries an outer flange 42. Once removed, as can be seen in FIG. 3, the firearm can be seated onto the weapon mount 10 at the first seating location 60 on the rear support 26, as well as the second seating location 61 (not shown) on the forward support 24 (not shown). The locking shaft 34 which is arranged along a locking shaft transversely aligned axis 58 is essentially located within the non-seating but locking location 62 somewhere within the center portion of the trigger guard 48. The user can then place the cylindrical housing 44 of the locking mechanism 40 onto the locking shaft 34 where the outer diameter of the cylindrical housing 44 has a lesser diameter than the inner diameter of the trigger guard 48. Also, the outer diameter or width of the outer flange 42 of the locking mechanism as attached to the top portion of the cylindrical housing 44 has a greater diameter than the inner diameter of the trigger guard 48. This is so that once the user locks the locking mechanism 40 onto the locking shaft 34, the firearm cannot be removed from the wall mount 10 without first removing the locking mechanism 40. Still referring to FIG. 4, once the locking mechanism 40 is in place, the mounted firearm display assembly 70 is completed where the entire assembly is attached to the wall 72 or other vertical surface.

Figure 6:
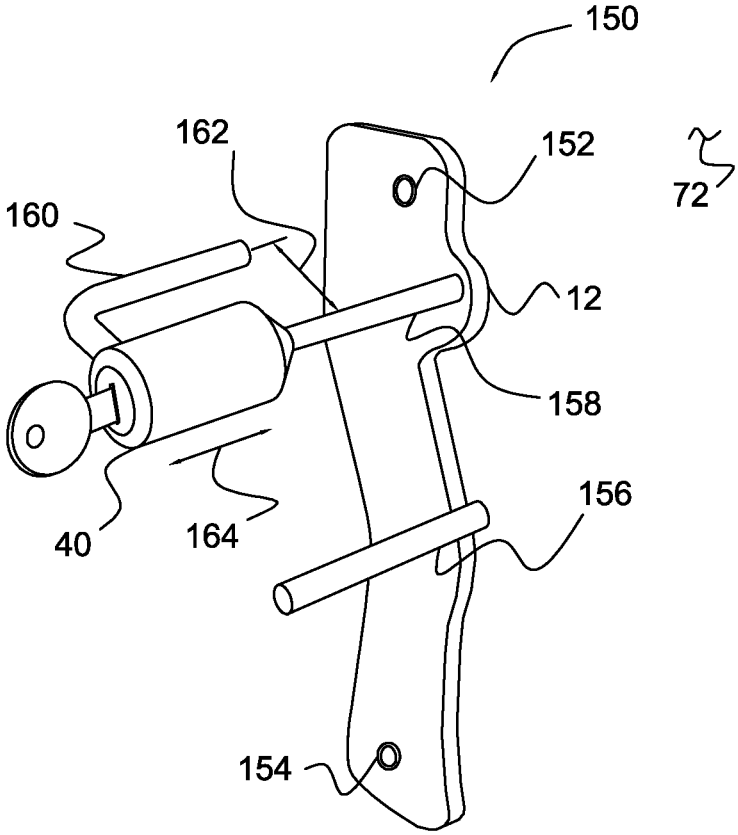
FIG. 6 is a overall perspective view of an alternative embodiment of the weapon wall mount apparatus.
Figure 7:
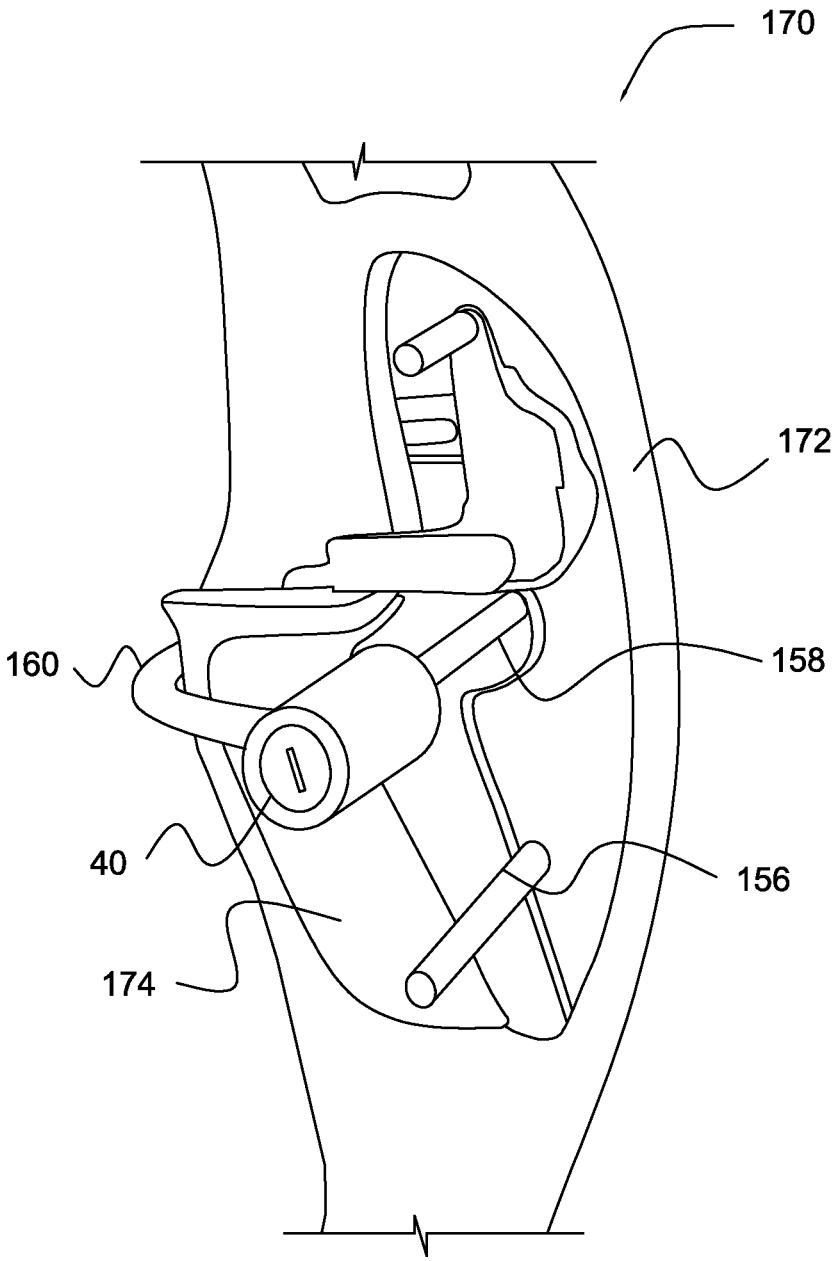
FIG. 7 is an overall perspective view of an alternative embodiment of the weapon wall mount apparatus holding a compound bow.

In addition, an alternative embodiment of the weapon wall mount utilizing a compound bow configuration 150 as seen in FIGS. 6 and 7 will now be provided. In this particular embodiment, the wall mount for bow configuration 150 includes a base plate 12 which is arranged to silhouette the bow handle of a compound bow. The base plate 12 includes an upper countersunk hole 152 as well as a lower countersunk hole 154 enabling the user to vertically align the wall mount with for example a single wall stud in the wall 72 for secure attachment. To provide for vertical and rotational resistance, a first upper support post 158 which is transversely aligned perpendicular to the base plate 12 extends out from the base plate to receive the locking mechanism 40. A lower support post-156 is also transversely aligned and perpendicular to the base plate for providing additional vertical and rotational support of the compound bow. Each support in this particular embodiment is constructed from ¼" diameter steel rod. Alternative diameters may be utilized. In this particular embodiment, the locking mechanism 40 also includes a locking bar 160. A locking bar 160 is L-shaped and extends radially from the cylindrical casing of the locking mechanism 40. The non-radial portion of the locking bar which extends perpendicular to the radial portion in the transverse direction is configured to encompass the outer edge of the compound bow handle. A handle space 162 which ranges from between one and 4 inches is designed to allow the users to encompass the bow handle while not allowing the bow to be removed from the wall mount. In locking and unlocking the wall mounts, the user will move the locking mechanism in a transversely aligned axial translation to lock down the compound bow. While this particular embodiment utilizes a compound bow, other embodiments may utilize string bows and the like.

Referring to FIG. 7, the weapon wall mount with compound bow assembly 170 is shown where the locking mechanism 40 has encompassed the bow handle 174. The bow handle itself is supported vertically by the lock bar 160 and the upper support post-158 while in the bow handle 174 is rotationally supported by the lower support post-156. While the weapon wall mount 150 has three supports, the upper support post-158, the lower support post-one 156 and the locking bar 160, additional supports may be provided about the perimeter edge of the base plate 12 to further secure and stabilize the weapon.

Figure 5:
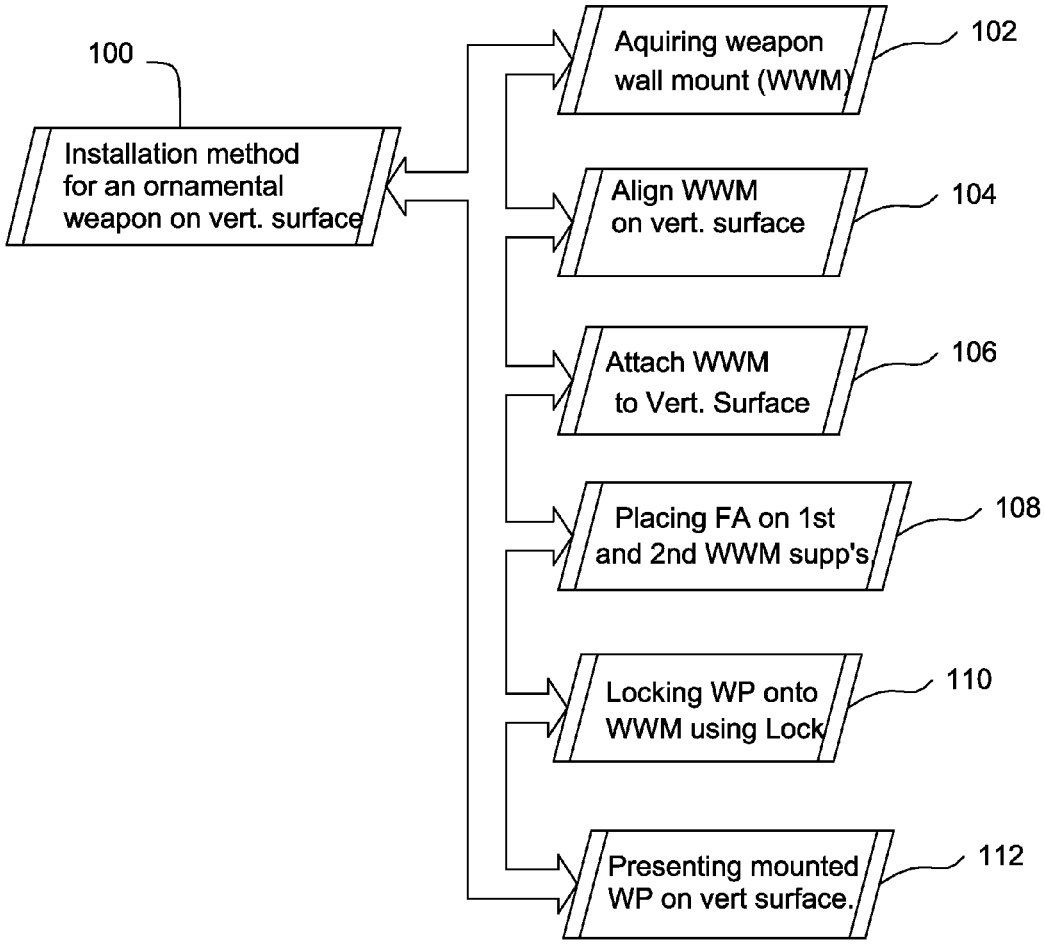
FIG. 5 is a schematic flowchart of the installation method.

Referring to FIG. 5, a detailed discussion of the installation method for an ornamental firearm on a vertical surface 100 will now be provided. At step 102, a user will acquire a weapon wall mount for placement of the firearm or other weapon onto a vertical surface. The user will then at step 104 align a weapon wall mount 10 (FIG. 1) in an ornamental position on the vertical surface. In other words, the user will utilize the weapon wall mount as a substitute for the firearm itself in determining the final ornamental arrangement or placement of the firearm on the surface itself.

At step 106, once the user has decided on the particular location for the firearm to be mounted on the wall, the user will attach the weapon wall mount to the vertical surface. In doing so, the user will do one of the following. Determine the locations of at least a first stud spaced at approximately 16" on-center within the wall itself, and then determine the location of at least a second stud spaced at approximately 16" on-center. The user may then align the weapon wall mount's countersunk holes which, as previously discussed above, are longitudinally aligned along the top half portion of the wall mount 10 where the countersunk holes are spaced at approximately 2" on-center. The user will align one of the holes to the first stud and one of the other plurality of holes to the second stud. The user then will utilize attachment means to secure the weapon wall mount through the countersunk holes to the first and second studs. The attachment means may be a wall screw, or other fastener mechanism. In the alternative, the user may utilize sheet rock anchors aligned with the countersunk holes and then utilize sheet rock anchor screws to attach the weapon wall mounts to the vertical surface.

Once the weapon wall mount is placed on the wall, the user can at step 108 place the firearm on the first and second weapon wall mount supports. The user can then lock the firearm onto the weapon wall mount at step 110 using the locking mechanism. In doing so, the user will attach the locking mechanism to the locking shaft at the trigger guard 48 and thereby prevent the firearm from being removed from the wall mount unless the user removes the locking mechanism first. Lastly, at step 112, the firearm is presented on the vertical surface and appears to be mounted directly to the wall while being securely locked and mounted on the weapon wall mount 10 itself.

Therefore I claim:

1. A weapon wall mount comprising:

a. a continuous base plate configured to match the silhouette of a weapon, said continuous base plate comprising a plurality of equidistantly spaced countersunk holes configured for uniform attachment to a wall comprising a plurality of wall studs equidistantly spaced a range of between 12 inches and 24 inches on center;

b. said continuous base plate further configured to be arranged within a longitudinal plane comprising a vertical direction and a longitudinal direction, said continuous base plate further comprising a transversely aligned support;

c. said transversely aligned support configured to provide longitudinal and vertical support of said weapon;

d. said continuous base plate further comprising a transversely aligned locking shaft configured to receive a locking mechanism, said locking mechanism configured to provide transverse restraint of said weapon;

e. whereby with said weapon supported by said transversely aligned support and locked in place by said locking mechanism, said weapon restricts access to said plurality of equidistantly spaced countersunk holes when said continuous base plate is securely attached to the wall at the plurality of wall studs, thus providing the appearance of said weapon securely fastened and mounted to said wall without the noticeable visual appearance of a support.

2. The weapon wall mount according to the claim 1 wherein said wall mount further comprises: a steel material, a black powder coating for covering said steel material and providing said weapon wall mount with a shadow like finish.

3. The weapon wall mount according to claim 1 wherein said transversely aligned support further comprises: a first transversely aligned support arranged at a forward end of said base plate, a second transversely aligned support arranged at a rearward end of said base plate.

4. The weapon wall mount according to claim 1 wherein said transversely aligned support further comprises: a first transversely aligned support arranged at a bottom end of said base plate, a second transversely aligned support arranged at a top end of said base plate, a third transversely aligned support comprising said locking shaft.

5. The weapon wall mount according to claim 1 wherein said locking mechanism further comprises: a locking bar configured to encompass a handle of a compound bow while said compound bow is mounted on said base plate, said base plate configured into a silhouette of at least a compound bow handle.

6. The weapon wall mount according to claim 1 wherein said base plate further comprises: a silhouette configured to match a firearm.

7. The weapon wall mount according to claim 6 wherein said transversely aligned locking shaft is further configured to extend from said base plate through a trigger guard on said firearm.

8. The weapon wall mount according to claim 7 wherein said locking mechanism is further configured to lock onto said transversely aligned locking shaft through said trigger guard whereby said trigger is inaccessible and said weapon cannot be removed from said base plate without removing said locking mechanism.

9. The weapon wall mount according to claim 8 wherein said locking mechanism further comprises: a cylindrical body maintaining said locking mechanism, a top flange comprising a diameter greater than said trigger guard whereby with said locking mechanism is installed on said transversely aligned locking shaft, said trigger guard is restrained by said top flange and cannot pass over said locking mechanism preventing removal of said firearm from said wall mount.

10. The weapon wall mount according to claim 1 wherein said base plate further comprises: a silhouette configured to match a rifle.

11. The weapon wall mount according to claim 1 wherein said base plate further comprises: a thickness in the transverse direction ranging from approximately ⅛ of an inch to approximately 1 inch.

12. The weapon wall mount according to claim 1 wherein said base plate further comprises: a base plate material constructed of one or more of the following: wood, aluminum, carbon fiber, ceramic, steel, plastic.

13. The weapon wall mount according to claim 1 wherein said base plate further comprises: a base plate covering comprising rubber.

14. The weapon wall mount according to claim 1 wherein said base plate further comprises: a silhouette configured to match a handgun.

15. The weapon wall mount according to claim 1 wherein said base plate further comprises: a silhouette configured to match a shotgun.

16. The weapon wall mount according to claim 1 wherein said base plate further comprises: a silhouette configured to match a Tommy gun.

17. The weapon wall mount according to claim 1 wherein said base plate for the comprises: a silhouette configured to match a machine gun.

18. A method for installing a weapon on a vertical surface, said method comprising:

a. a user acquiring a weapon wall mount comprising a continuous base plate configured to match the silhouette of a weapon, said continuous base plate comprising a plurality of equidistantly spaced countersunk holes, a transversely aligned support, a transversely aligned locking shaft, and an interoperable locking mechanism;

b. aligning said weapon wall mount on said vertical surface by arranging said plurality of equidistantly spaced countersunk holes in alignment with a plurality of wall studs equidistantly spaced a range of between 12 inches and 24 inches on center;

c. attaching said weapon wall mount to said vertical surface by securely fastening said weapon wall mount to said vertical surface;

d. placing a weapon on said transversely aligned support and providing longitudinal and vertical support of said weapon;

e. locking said weapon onto said weapon wall mount by attaching said interoperable locking mechanism to said transversely aligned locking shaft and restraining said weapon from movement in a transfers direction, a vertical, and a longitudinal direction;

f. providing the appearance of said weapon securely fastened and mounted to said wall without the appearance of said weapon wall mount.

19. The method according to claim 18 wherein said base plate further comprises: a silhouette configured to match a firearm.

20. The method according to claim 19 wherein said base plate further comprises: a silhouette configured to match a compound bow.

* * * * *